US006399265B2

(12) United States Patent
Ogura

(10) Patent No.: US 6,399,265 B2
(45) **Date of Patent: *Jun. 4, 2002**

(54) TRANSPARENT FILM FOR FORMING TONER IMAGE AND PROCESS FOR FORMING TONER IMAGE USING THE SAME

(75) Inventor: Motohiro Ogura, Odawara (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/348,498

(22) Filed: Jul. 7, 1999

(30) Foreign Application Priority Data

Jul. 9, 1998 (JP) ..... 10-194422

(51) Int. Cl.[7] ..... G03G 13/20
(52) U.S. Cl. ..... 430/124; 430/17; 430/18
(58) Field of Search ..... 430/124, 17, 18

(56) References Cited

U.S. PATENT DOCUMENTS

| | | | | |
|---|---|---|---|---|
| 4,973,509 A | * | 11/1990 | Yamane | 428/195 |
| 6,060,203 A | * | 5/2000 | Coburn et al. | 430/124 |

FOREIGN PATENT DOCUMENTS

| | | | | |
|---|---|---|---|---|
| EP | 0 633 508 A2 | | 1/1995 | |
| EP | 0 706 094 A1 | | 4/1996 | |
| EP | 0 844 534 A1 | | 5/1998 | |
| JP | 61-273554 | | 12/1986 | |
| JP | 1-263085 | | 10/1989 | |
| JP | 2-263642 | | 10/1990 | |
| JP | 5-181300 | | 7/1993 | |
| JP | 6-19180 | | 1/1994 | |
| JP | 6-332221 | | 12/1994 | |
| JP | 07047776 | * | 2/1995 | B41M/5/38 |
| JP | 7-199515 | | 8/1995 | |
| JP | 9-218527 | | 8/1997 | |
| JP | 10307416 | * | 11/1998 | G03G/7/00 |
| JP | 61106293 | * | 11/1998 | B41M/5/26 |

* cited by examiner

*Primary Examiner*—Mark Chapman
(74) *Attorney, Agent, or Firm*—Fitzpatrick, Cella, Harper & Scinto

(57) ABSTRACT

A transparent film for forming a toner image is disclosed. The transparent film has a transparent base material and a resin layer provided on the surface thereof, and the resin layer has a release oil. This transparent film does not cause sticking to an image fixing roller. Also, disclosed is a process for forming a transparent color image by using the transparent film. This process forms a transparent color image which is able to exhibit color reproductivity of middle tone and excellent coloring property when projected by an overhead projector (OHP) and does not interfere with a fixing roller.

10 Claims, 1 Drawing Sheet

TRANSPARENT FILM FOR FORMING TONER IMAGE AND PROCESS FOR FORMING TONER IMAGE USING THE SAME

BACKGROUND OF THE INVENTION

1. Field of the Invention

The present invention relates to a transparent film for forming a toner image, and a process for forming a toner image. More specifically, the present invention relates to a process for forming a toner image in accordance with an electrophotographic process.

2. Related Background Art

In the general process for forming a full-color image, a full-color image has heretofore been formed in the following manner. A magenta toner image is formed by uniformly charging a photosensitive member of a photosensitive drum, conducting image exposure with a laser beam modulated by magenta image signals of an original document to form an electrostatic latent image on the photosensitive drum, developing the electrostatic latent image by a magenta developing device to form a magenta toner image on the photosensitive drum, and transferring the magenta toner image developed on the photosensitive drum by means of a charger for transfer to a recording medium that has been fed.

After completion of the above-described development and transfer, the photosensitive drum is then subjected to static charge elimination by a charger for static charge elimination, cleaned and again charged by a primary charger to conduct the formation of a cyan toner image on the photosensitive drum and the transfer of the cyan toner image to the recording medium, to which the magenta toner image has been transferred, in the same manner as described above. Further, this process is successively conducted as to a yellow color and a black color to transfer the toner images of the four colors to the recording medium. Furthermore, the toner images of the four colors are fixed to the recording medium by the action of heat and pressure by a fixing means such as a fixing roller, thereby forming a full-color image.

In recent years, such image forming apparatus have not been limited to use only as copying machines for office management for copying so-called original documents, and have begun to be used in the fields of printers as output devices for computers and personal copying for individual use. Besides the field typified by such a laser beam printer, the development of facsimiles for plain paper making use of the basic technology is also rapidly growing.

Therefore, in such an image forming apparatus as described above, smaller size, lighter weight, higher speed and higher image quality, and higher reliability have been pursued, and so the apparatus has come to be constructed by simpler elements at various points. As a result, toners have also been required to have higher performance. Therefore, an excellent image forming apparatus has not come to be realized unless improvement in the performance of the toners has been achieved.

In keeping with the various needs of copying in recent years, the demand for color copying has rapidly increased. In order to more faithfully copy an original color image, still higher image quality and higher resolution have been desired. From these points of view, toners used in a color-image forming process are required to be good in melting ability and color-mixing ability upon application of heat, and there is hence a demand for development of toners high in sharply melting ability, which have a low softening point and a low melting temperature. The use of such toners high in sharply melting ability enables widening the color tone reproducibility range of copies and is able to obtain color copies faithful to the original color image.

However, such toners high in sharply melting ability generally have high affinity for a fixing roller and tend to offset to the fixing roller. In particular, in the case of a fixing means in a color-image forming apparatus, there is a tendency to easily cause offset due to increase in the thickness of toner layers by the formation of a plurality of toner layers composed of magenta toner, cyan toner, yellow toner and black toner on a recording medium.

In order to improve the releasability of toners from a fixing roller, it has heretofore been conducted to, for example, form the surface of the fixing roller with a material having excellent release property (for example, silicone rubber or fluororesin) for the toners and further coat the surface with a thin film of a liquid having high release property, such as silicone oil or fluorine-containing oil to prevent offset and the fatigue of the roller surface. This method is extremely effective in that the offset of toners is prevented, but involves problems that a device for feeding an anti-offset liquid is required to complicate the fixing device and that the oil applied causes delamination or peeling between layers making up the fixing roller to consequently facilitate shortened life of the fixing roller.

In keeping with the various needs of copying in recent years, various kinds of paper, coated paper and plastic films have been used as recording mediums. In particular, attention is paid to the necessity of light-transmitting sheets (OHP sheets) for utilizing an over-head projector (OHP) for presentation. The OHP sheet has low oil-absorbing capability, unlike paper, so that the oil used in the above-described fixing device adheres to the surface of the OHP sheet. As a result, the OHP sheet, on which an image has been formed, has been unable to avoid having a sticky feel due to the adhesion of the oil and incurs deterioration of the image quality. In addition, there is a possibility that a releasing oil such as silicone oil may be evaporated by heat to contaminate the interior of the fixing device, or that problems such as treatment of recovered oil may arise.

Accordingly, it is greatly expected to establish a fixing system which can solve the above-described problems and does not require oil application upon the fixing of an image, and to develop novel toners for that purpose.

In order to achieve the above subject, Japanese Patent Application Laid-Open No. 61-273554 discloses a toner comprising a release agent such as a wax. In case of the toner containing a wax, the thermal conductivity of the toner is enhanced by virtue of the wax which melts at a lower temperature. As a result, the fixing at a low temperature is feasible. More preferably, the wax melted upon fixing is also able to act as a release agent, and so offset at a high temperature can be prevented without applying a release agent such as an oil to the fixing roller.

When a color toner image or full-color toner image is formed on a light-transmitting sheet using an electrophotographic system according to a dry developing process and the image is projected by means of an OHP apparatus, there is presented a phenomenon that the projected image exhibits a grayish tone as a whole though the full-color image on the light-transmitting sheet shows sufficient coloring property, and so the range of color tone reproduction becomes very narrow. This phenomenon presents itself for the following reason. Namely, since the unfixed toner image formed on the light-transmitting sheet with a smooth surface is not fully made fluid even by heating upon image fixing and retains graininess, incident light is scattered upon projection to cast a shadow on the screen. In a middle tone area or highlight area of image, at which the image density is low, in particular, the absorption by the dye or pigment in the toner of each color is lowered due to the decreased number of toner particles. Therefore, the color tone to be reproduced becomes grayish.

On the other hand, when a toner image formed on a recording medium such as plain paper is visually observed, an reflected image of light struck on the toner image is visually observed. Therefore, the image quality is scarcely influenced even when some graininess is left on the toner surface. When the toner image is observed or projected on a screen as transmitted light like OHP, however, the light transmission property is deteriorated due to the scattering of light if the shape of the toner particles is clearly retained, so that the tone becomes grayish. Accordingly, a recording medium used in OHP is required to have an effect of reducing the graininess of toners after the fixing of a color image to improve light transmission property.

Therefore, various light-transmitting recording mediums provided with a surface layer formed of a thermoplastic resin such as a styrene-acrylic resin or polyester resin on their transparent base sheets have heretofore been proposed as recording mediums for electrophotography from the viewpoints of improvement in the clarity or sharpness of images due to the enhancement of the fixing ability of toners and improvement in the conveyability and blocking resistance of the recording medium. For example, Japanese Patent Application Laid-Open Nos. 1-263085, 6-19180, 6-19485 and 6-332221 may be mentioned.

As a means for reducing the graininess of toners after the fixing to improve light transmission property, there is used a method in which toner particles are embedded into a surface layer by heat and pressure upon the fixing, as described in Japanese Patent Application Laid-Open Nos. 2-263642 and 7-199515. In these light-transmitting recording mediums, the graininess of the toners after the fixing is improved by the effect of the resin forming the surface layer. Therefore, the light transmission property is improved, and so the projectability in OHP becomes excellent. When a resin, which is not fully plasticized by heat and pressure upon the fixing, is used in the surface layer, however, the penetration of toner particles into the receiving layer, or the surface layer is extremely reduced, and so the projected image comes to exhibit a grayish tone.

All the above-described recording mediums have been those used in the case where a toner image is fixed by using a release agent such as an oil for a fixing roller. Namely, as to the OHP sheets mentioned above, an oilless fixing process, in which a wax is contained as a release agent in a toner and no release agent such as oil is applied to the surface of the fixing roller, is not taken into consideration. Therefore, when such toner as described above is used to heat and fix a toner image with a small amount of toner, the image area proportion of which is only about 5%, to the OHP sheet, the offset resistance is satisfactory at the toner image area by virtue of the action of the wax as a release agent in the toner, but the action of the wax as a release agent becomes insufficient at an area on which the toner image is not formed over a wide range to tend to bring about such a phenomenon that the surface layer formed of the thermoplastic resin sticks to the fixing roller. Accordingly, there is a demand for improvement in the recording mediums so as to be suited to the oilless fixing process making use of the above-mentioned toner.

Japanese Patent Application Laid-Open No. 5-181300 describes that a toner containing a wax component is heated and fixed to a transparent recording medium by using the oilless fixing process in which the surface of the fixing roller is not coated with a release agent such as an oil. However, this document does not describe anything about the fact that a toner image with a little toner having an image area proportion of less than 5% is fixed.

Japanese Patent Application Laid-Open No. 9-218527 has proposed that a release agent of wax type is used to prevent a recording medium from sticking to a fixing roller. According to this proposal, a release agent having a clear melting point is contained in a thermoplastic resin. In this case, the wax is melted upon fixing to impart releasability to the recording medium. When the thermoplastic resin has a glass transition temperature (Tg) comparable to that of toners, however, sticking of the thermoplastic resin to the fixing roller may occur in some cases before the wax is melted. In addition, in the case of the resin containing wax, its transparency becomes insufficient by any means, so that the coloring property of the resulting color image may become insufficient in some cases when it is projected by OHP.

SUMMARY OF THE INVENTION

It is an object of the present invention to provide a transparent film for forming a toner image, which does not cause sticking to a fixing roller.

Another object of the present invention is to provide a process for forming a transparent color image exhibiting color reproductivity of middle tone and excellent coloring property when projected by OHP and not interfering with a fixing roller by using the transparent film for forming a toner image.

The above objects can be achieved by the present invention described below.

According to the present invention, there is thus provided a transparent film for forming a toner image, comprising a transparent base material and a resin layer provided on the surface thereof, wherein the resin layer has a release oil.

According to the present invention, there is also provided a process for forming a toner image, comprising the steps of forming a toner image on a transparent film comprising a transparent base material and a resin layer provided on the surface thereof and fixing the toner image by heating and pressurizing it, wherein the resin layer has a release oil.

In the transparent film for forming a toner image according to the present invention, the release oil is present in or on the resin layer on which a toner image will be formed. Therefore, the release oil can directly act on a fixing means such as a fixing roller upon fixing images by heating and pressurizing, or heat-and-pressure fixing of images to prevent the transparent film from sticking to the fixing means. Since the release oil is liquid unlike waxes even when it is not melted, the effect of preventing the sticking of the transparent film to the fixing means can be developed promptly.

DESCRIPTION OF THE PREFERRED EMBODIMENTS

In the present invention, the release oil that the resin layer has is preferably present in the resin layer or on the surface of the resin layer. A transparent film in which the release oil is present in the resin layer can be produced by containing the release oil in a coating formulation used for forming the resin layer by coating. On the other hand, a transparent film in which the release oil is present on the surface of the resin layer can be produced by coating a base material with a coating formulation containing no release oil, drying the coating layer and then applying a release oil to the coating layer.

Figure 1:
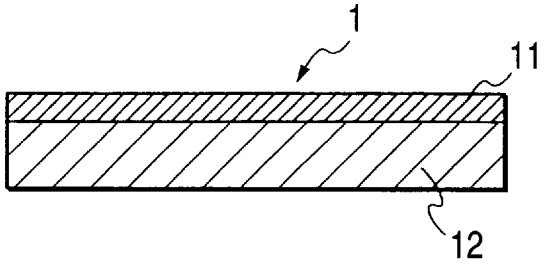
FIG. 1 is a schematic cross-sectional view of a transparent film according to the present invention.

FIG. 1 is a schematic cross-sectional view illustrating the layer structure of a general transparent film used in the present invention. As illustrated in FIG. 1, the transparent film 1 according to the present invention is a transparent film comprising a transparent base material 12 and a resin layer 11 provided on the surface thereof. A release oil is mixed into this resin layer.

As the transparent base material 12, any conventionally-known material can be used. Specific examples thereof include films and sheets of plastics such as polyester resins, diacetate resins, triacetate resins, polystyrene resins, polyethylene resins, polycarbonate resins, polymethacrylate resins, cellophane, celluloid, polyvinyl chloride resins and polyimide resins. No particular limitation is imposed on the thickness of this transparent base material. However, it is preferred from the viewpoint of conveyability that the thickness be preferably about 50 to 200 $\mu$m, more preferably 70 to 150 $\mu$m.

The resin layer 11 will hereinafter be described. As a resin for forming the resin layer 11, there is used any of various thermoplastic resins such as polyester resins, polymethyl methacrylate resins, acrylic resins, styrene resins, styrene-acrylic resins, rubber resins, epoxy resins, vinyl chloride resins, vinyl acetate resins and polyurethane resins. The glass transition temperature (Tg) of the thermoplastic resin is preferably comparable to that of a toner or within a range defined by (the Tg of the toner ±10° C.). If the Tg is outside this temperature range, the compatibility of the resin layer with the toner becomes poor, and so irregular reflection of light occurs at an interface therebetween, which causes the resulting image to look grayish when projected by OHP.

The glass transition temperature (Tg) is measured by means of an inside heating and input compensating type differential scanning calorimeter (DSC), which is high in accuracy from the measuring principle thereof. As the measuring apparatus, for example, DSC-7 manufactured by Perkin Elmer Company may be used. The measurement was carried out in accordance with ASTM D 3418-82. In the present invention, preferably 5 to 20 mg, more preferably 10 mg of a sample to be measured was precisely weighed and placed in an aluminum pan, and an empty aluminum pan was used as a reference. Both pans were heated from −100° C. to 200° C. at a heating rate of 10° C./min in a nitrogen atmosphere to conduct the measurement. In the present invention, in the course of this heating, respective base lines before and after shift of the base line were extrapolated in mutual directions, and an intersection between a line at the intermediate point thereof and a differential thermal curve was regarded as Tg.

Figure 2:
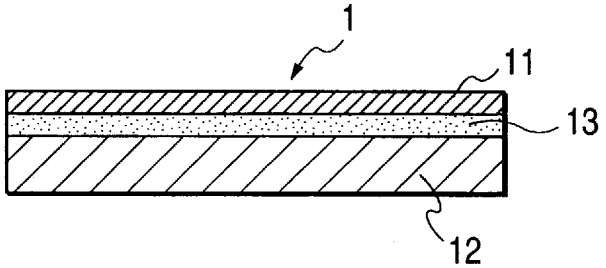
FIG. 2 is a schematic cross-sectional view of another transparent film according to the present invention.

Besides, an adhesive layer 13 may be provided between the resin layer 11 and the transparent base material 12 as illustrated in FIG. 2. Specific examples thereof include layers of resins such as ester resins, acrylic ester resins, methacrylic ester resins, styrene-acrylic ester copolymers and styrene-methacrylic ester copolymers.

As the release oil mixed into the resin layer or applied to the surface thereof, there is used any of various oils having release property, such as silicone oil, fluorine-containing oil, ester oil, liquid polyether, spindle oil, machine oil and cylinder oil. Silicone oil is particularly preferred.

As the silicone oil, dimethyl silicone oil, phenylmethyl silicone oil, alkyl-modified silicone oil, fluorosilicone oil, polyether-modified silicone oil or fatty acid ester-modified silicone oil, or any of modified silicone oils such as epoxy-modified, alkyl-modified, fluorine-modified, amino-modified, carboxyl-modified, alcohol-modified, alkylaralkyl polyether-modified, epoxy.polyether-modified and polyether-modified silicone oils, for example, are desired.

The molecular weight of the silicone oil is preferably 2,000 to 50,000 g/mol. If the molecular weight exceeds 50,000 g/mol, the light transmission property of the resulting transparent film is influenced. If the molecular weight is lower than 2,000 g/mol, on the other hand, the coating property of such an oil becomes deteriorated. The amount of the silicone oil added is preferably 0.01 to 10% by weight. More preferably, at least 0.01% by weight is preferred from the viewpoint of preventing the sticking of the resulting transparent film to a fixing means, while at most 10% by weight is preferred from the viewpoint of preventing the occurrence of irregular reflection at an interface between the silicone oil and a toner so as not to provide a grayish image.

The thickness of the resin layer is preferably about 1 to 20 $\mu$m, more preferably 2 to 10 $\mu$m. However, if the resin layer is too thin, toner particles may not be embedded into the resin layer. If it is too thick, on the other hand, sticking between the resulting films, such as blocking, may occur. In this connection, this thickness is a thickness including the release oil when the release oil is present on the surface of the resin layer.

The haze (JIS K 6714) of the whole transparent film is preferably at most 5%. If the haze exceeds 5%, the state of a projected image and the color tone reproducibility may be insufficient. The surface resistivity of the film itself is controlled to a value suitable for the transfer of toners by mixing an antistatic agent into the resin layer or coating the surface of the resin layer with the antistatic agent. The surface resistivity at this time is desirably $1\times10^{8}$ to $1\times10^{14}$ Ω.

As the antistatic agent, there may be used any conventionally-known agent. Examples thereof include quaternary ammonium salt type compounds, pyridinium salt type compounds, phosphonium salt type compounds, alkylbetaine type compounds, alkylimidazoline type compounds, alkylalanine type compounds, polyoxyethylene type nonionic compounds, polyhydric alcohol type nonionic compounds, electroconductive resins such as polyvinylbenzyl type cations and polyacrylic acid type cations, and ultrafine particles of metal oxides such as $SnO_2$ and $SnO_2$—Sb.

The constitution of toners used in a fixing process by heating and pressurizing according to the present invention will hereinafter be described. The toners used in the fixing process by heating and pressurizing according to the present invention preferably contain a wax component since the toners are used in an oilless fixing process or a fixing process in which a fixing roller is coated with a small amount of an oil.

Examples of the wax component as a release agent contained in the toners used in the present invention include paraffin wax, polyolefin wax and modified products thereof (for example, oxides and graft-treated products), higher aliphatic compounds and metal salts thereof, and amide wax. However, the wax component is not in any way limited to these waxes.

The content of the wax component in a toner in the present invention is preferably 1 to 50 parts by weight, more preferably 5 to 45 parts by weight based on 100 parts by weight of a binder resin used in the toner. If the content of the wax component in the toner is lower than 1 part by weight, it is difficult for the resulting toner to achieve satisfactory releasability when it is applied to the oilless fixing process, and so an offset phenomenon may occur in some cases. If the content exceeds 50 parts by weight on the other hand, the blocking resistance and storage property of the resulting toner are deteriorated.

The toner containing the wax component may be produced by using any of the following production processes. One is a process of producing a polymerized toner, in which a monomer composition comprising a polymerizable monomer, a wax component and a colorant is polymerized to produce toner particles, and the other is a process of producing a pulverized toner, in which materials constituting a toner comprising a binder resin, a wax and a colorant are melted, kneaded, pulverized and classified to produce toner particles.

In the present invention, the process of producing a polymerized toner is advantageous when a toner containing a large amount of a wax component is to be obtained. In particular, a process of producing a toner by suspension polymerization, in which the above-described monomer composition is subjected to suspension polymerization in an aqueous medium, thereby producing toner particles, is preferred because the amount of the wax component in the toner can be increased.

Examples of the polymerizable monomer used in the polymerized toner include styrenic monomers such as styrene, o-methylstyrene, m-methylstyrene, p-methylstyrene, p-methoxystyrene and p-ethylstyrene; acrylic esters such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chloroethyl acrylate and phenyl acrylate; methacrylic esters such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate and diethylaminoethyl methacrylate; and besides monomers such as acrylonitrile, methacrylonitrile and acrylamide.

These monomers may be used either singly or in any combination thereof. Of the above-mentioned monomers, styrene or a styrene derivative is preferably used alone or in combination with another monomer from the viewpoint of the developing property and durability of the resulting toner.

In the case where a toner is produced in accordance with the process of producing a pulverized toner, examples of a polymer used as a binder resin for the toner include resins obtained by polymerizing a monomer, such as acids such as acrylic acid, methacrylic acid and maleic acid and esters thereof, or resins obtained by copolymerizing at least two of these monomers; polyester; polysulfonate; polyether; and polyurethane.

The toners used in the present invention are preferably toners which form color images in particular. As colorants contained in the toners, any known colorants may be used. Examples thereof include carbon black; iron black; dyes such as C.I. Direct Red 1, C.I. Direct Red 4, C.I. Acid Red 1, C.I. Basic Red 1, C.I. Mordant Red 30, C.I. Solvent Red 49, C.I. Solvent Red 52, C.I. Direct Blue 1, C.I. Direct Blue 2, C.I. Acid Blue 9, C.I. Acid Blue 15, C.I. Basic Blue 3, C.I. Basic Blue 5, C.I. Mordant Blue 7, C.I. Direct Green 6, C.I. Basic Green 4 and C.I. Basic Green 6; and pigments such as chrome yellow, cadmium yellow, Mineral Fast Yellow, Navel Yellow, Naphthol Yellow S, Hansa Yellow G, Permanent Yellow NCG, Tartrazine Lake, molybdenum orange, Permanent Orange GTR, Benzidine Orange G, cadmium red, Permanent Red 4R, Watchung Red Ca salt, Brilliant Carmine 3B, Fast Violet B, Methyl Violet Lake, iron blue, cobalt blue, Alkali Blue Lake, Victoria Blue Lake, quinacridone, dis-azo type yellow pigments, Phthalocyanine Blue, Fast Sky Blue, Pigment Green B, Malachite Green Lake and Final Yellow Green G.

In the case where a toner is obtained in accordance with the polymerization process in the present invention, care must be given to the polymerization inhibitory property and migration property to an aqueous phase that the colorant may have. It is hence preferable to previously conduct surface modification such as a hydrophobicity-imparting treatment with a substance which does not inhibit the polymerization.

The fixing process by heating and pressurizing in the present invention will hereinafter be described. The fixing process by heating and pressurizing according to the present invention is characterized by fixing a toner image to the light-transmitting recording medium for electrophotography according to the present invention, which has such a structure as described above, by a fixing means by heating and pressurizing. A fixing device suitable for the application of the fixing process by heating and pressurizing according to the present invention will be described.

Figure 3:
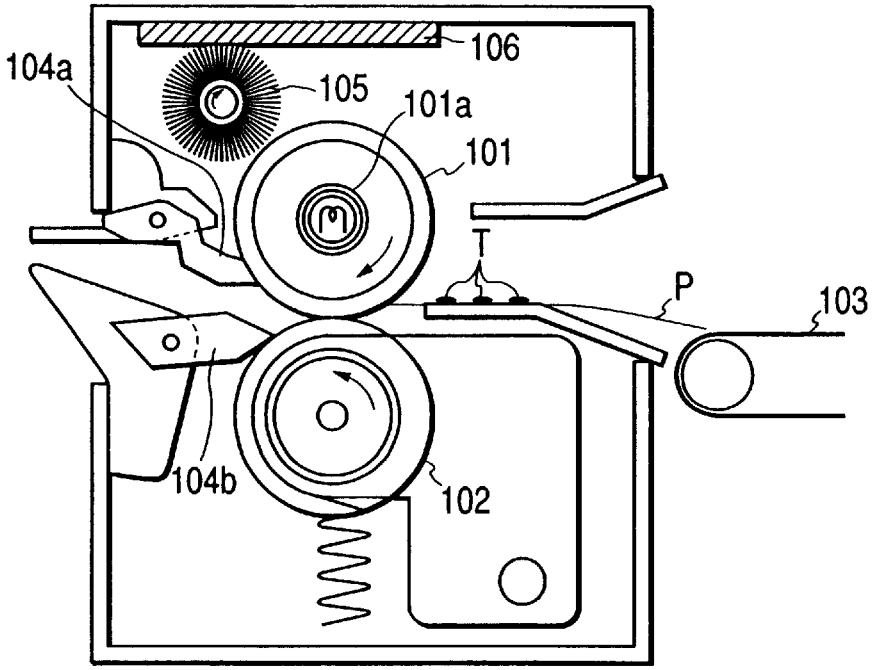
FIG. 3 is a cross-sectional view of a heating roller type fixing device.

FIG. 3 is a schematic cross-sectional view illustrating an exemplary heating roller type fixing device. As illustrated in FIG. 3, this device is equipped with a cylindrical heating roller 101 having a heating means such as a heater 101*a* in the interior thereof. The heating roller 101 rotates on its axis in the clockwise direction upon fixing. Reference numeral 102 designates a cylindrical pressure roller as a pressurizing rotator. The pressure roller 102 rotates on its axis in the counterclockwise direction in contact under pressure with the heating roller 101 upon fixing. A recording medium P as a material to be heated, to which an unfixed toner T has been adhered as a toner image, is fed by a conveyer belt 103 from the right-hand direction in FIG. 3 and pressed and heated by the heating roller 101 provided on the upper side and the pressure roller 102, whereby the unfixed toner T is fixed to the recording medium P, and the recording medium is discharged in the left-hand direction.

In FIG. 3, reference characters 104*a* and 104*b* indicate separation claws which are used in separation for preventing the recording medium P from winding around the heating roller 101 or the pressure roller 102 to cause poor conveyance of the recording medium P. Reference numeral 106 designates a felt-like oil pad soaked with a release agent such as silicone oil having a moderate viscosity, while reference numeral 105 indicates a cleaning roller cylindrically planted with brush fiber. The cleaning roller 105 rotates on its axis to remove toner residue adhered to the peripheral surface of the heating roller 101 and suitably supply the surface of the heating roller 101 with the release agent. The fixing means by heating and pressurizing used in the present invention may be a fixing means by heating and pressurizing in which an oil is separately supplied as illustrated in FIG. 3, but is preferably an oilless type fixing means by heating and pressurizing in which no oil is separately supplied. The oil pad 106 is unnecessary in the case of the oilless type fixing means by heating and pressurizing.

The present invention will hereinafter be described in more detail by the following examples.

EXAMPLE 1

A polyethylene terephthalate (PET) film having a thickness of 100 μm was used as a transparent base material and coated with a solution of a mixture of the following materials in acetone by a bar coater method to form a resin layer so as to give a dry coating thickness of 7 μm, thereby obtaining a transparent film. The haze value thereof was 3.0%.

| | Parts by weight |
|---|---|
| Polyester resin (Tg: 56° C.; trade name: Vylon, product of Toyobo Co., Ltd.) | 80 |
| Release oil (dimethyl silicone oil; molecular weight: 10,000 g/mol) | 2 |
| Antistatic agent (quaternary ammonium salt) | 2 |

After the following materials:

| | Parts by weight |
|---|---|
| Styrene-butyl acrylate-divinylbenzene copolymer | 100 |
| Polyolefin wax | 5 |
| C.I. Pigment Yellow 15 | 4.5 |
| Di-tert-butylsalicylic acid metal compound | 3 |

were mixed, the mixture was melted and kneaded by a twin-screw kneader extruder and cooled. The cooled product was then pulverized by a pneumatic pulverizer, and the pulverized product was classified by an air classifier to obtain a powdered yellow toner having a weight average particle diameter of 8.5 μm. To 100 parts by weight of the toner were added 0.8 parts by weight of negatively chargeable colloidal silica to obtain a yellow toner. The toner had a Tg of 57° C. and a volume average particle diameter of 8 μm.

The yellow toner obtained above was used to uniformly form a toner image on the above-obtained transparent film so as to give a density of 0.8. The unfixed yellow toner image was fixed at a fixing roller temperature of 195° C., an average fixing rate of 30 mm/sec and a pressure loading of 3 kg/cm$^2$ by means of a fixing roller coated with no release oil. At this time, the transparent film was discharged straight without winding around the fixing roller. The image thus obtained was measured by a spectrophotometer. As a result, its transmittance was 90%.

EXAMPLE 2

A transparent film was obtained in the same manner as in Example 1 except that the release oil was changed to phenylmethyl silicone oil (molecular weight: 10,000 g/mol). The transparent film was evaluated in the same manner as in Example 1 to investigate the winding of the transparent film around the fixing roller and the transmittance of the resultant image. As a result, no winding occurred, and the transmittance was 90%.

EXAMPLE 3

A transparent film was obtained in the same manner as in Example 1 except that the release oil was changed to alkyl-modified silicone oil (molecular weight: 10,000 g/mol). The transparent film was evaluated in the same manner as in Example 1 to investigate the winding of the transparent film around the fixing roller and the transmittance of the resultant image. As a result, no winding occurred, and the transmittance was 90%.

EXAMPLE 4

A PET film having a thickness of 100 μm was used as a transparent base material, and a resin layer was formed thereon using a polyester resin (Tg: 56° C.). A solution of silicone oil as a release oil in toluene was dispersed in water to prepare an emulsion. The emulsion was applied to the resin layer so as to give a dry coating thickness of 0.2 μm, thereby obtaining a transparent film. The transparent film was evaluated in the same manner as in Example 1 to investigate the winding of the transparent film around the fixing roller and the transmittance of the resultant image. As a result, no winding occurred, and the transmittance was 90%.

COMPARATIVE EXAMPLE 1

A transparent film was obtained in the same manner as in Example 1 except that no release oil was contained. The transparent film was evaluated in the same manner as in Example 1 to investigate the winding of the transparent film around the fixing roller and the transmittance of the resultant image. As a result, it was found that winding of the transparent film around the fixing roller occurred, and so the transparent film could not be easily separated from the fixing roller by a separation claw, resulting in a failure to discharge the transparent film.

EXAMPLE 5

A transparent film was obtained in the same manner as in Example 1 except that the amount of the release oil was changed to 50 parts by weight. The transparent film was evaluated in the same manner as in Example 1 to investigate the winding of the transparent film around the fixing roller and the transmittance of the resultant image. As a result, it was found that no winding around the fixing roller occurred, but the transmittance was reduced to a degree as extremely low as 50%.

COMPARATIVE EXAMPLE 2

A transparent film was obtained in the same manner as in Example 1 except that paraffin wax was used in place of the release oil. The transparent film was evaluated in the same manner as in Example 1 to investigate the winding of the transparent film around the fixing roller and the transmittance of the resultant image. As a result, it was found that the transparent film was curved on the fixing roller side, but was separated from the fixing roller by the separation claw, and so no winding around the fixing roller occurred. The transmittance was also as considerably high as 70%. However, the whole base became dark, and the resultant projected image was not clear.

EXAMPLE 6

A polyethylene terephthalate (PET) film having a thickness of 100 μm was used as a transparent base material and coated with a solution of the mixture of 80 parts by weight of a polyester resin (Tg: 56° C.; trade name: PELPRENE; product of Toyobo Co., Ltd.), 2 parts by weight of dimethyl silicone oil as a release agent and 2 parts by weight of a quaternary ammonium salt as an antistatic agent in acetone by a bar coater method to form a resin layer so as to give a dry coating thickness of 7 μm, thereby obtaining a transparent film. The haze value thereof was 3.0%.

A toner used in this example was produced in the following manner. To 709 parts by weight of ion-exchanged water were added 451 parts by weight of a 0.1 M aqueous solution of $Na_3PO_4$. After the mixture was heated to 60° C., it was stirred at 12,000 rpm by means of a TK type homomixer (manufactured by Tokushu Kika Kogyo Co., Ltd.). To this mixture were gradually added 67.7 parts by weight of a 1.0 M aqueous solution of $CaCl_2$, thereby obtaining a dispersion containing $Ca_3(PO_4)_2$.

Next, the following formulation was then provided.

| | Parts by weight |
|---|---|
| Styrene | 170 |
| 2-Ethylhexyl acrylate | 30 |
| Paraffin wax (m.p.: 75° C.) | 60 |
| C.I. Pigment Yellow 15 | 10 |
| Styrene-methacrylic acid-methyl methacrylate copolymer | 5 |
| Di-tert-butylsalicylic acid metal compound. | 3 |

Of the above formulation, only the C.I. Pigment Yellow 15, the di-tert-butylsalicylic acid metal compound and the styrene were preliminarily mixed by means of an Ebara Milder (trade name; manufactured by Ebara Corporation). The whole formulation was then heated to 60° C., dissolved and dispersed to obtain a monomer mixture. While keeping the monomer mixture at 60° C., 10 parts by weight of dimethyl 2,2'-azobisisobutylate as an initiator were added to the monomer mixture and dissolved therein, thereby preparing a monomer composition.

The monomer composition was poured into the dispersion prepared in a 2-liter flask of the above-described homomixer, and the resultant mixture was stirred at 60° C. for 20 minutes at 10,000 rpm by means of the TK type homomixer in a nitrogen atmosphere, thereby performing granulation of the monomer composition. While stirring the monomer composition by means of a paddle stirrer, it was then reacted at 60° C. for 3 hours and further polymerized at 80° C. for 10 hours.

After completion of the polymerization reaction, the reaction product was cooled, and hydrochloric acid was added thereto to dissolve $Ca_3(PO_4)_2$. The thus-treated reaction product was filtered, washed with water and dried to obtain a polymerized toner.

The particle diameter of the toner thus obtained was measured by means of a Coulter counter (manufactured by Coulter Co.). As a result, it was found that the toner had a weight average particle diameter of 8.2 μm and a sharp particle size distribution. Further, the section of the toner particle was observed though a transmission electron microscope in accordance with the stain ultrathin sectioning method. As a result, it was confirmed that the toner was structurally divided into a surface layer part composed mainly of a styrene-acrylic resin and a core part composed mainly of a wax to form a capsule structure.

The thus-obtained yellow toner was used to form a toner image on the transparent film, and the transparent film was then passed through the fixing device making no use of any release agent like Example 1. At this time, the transparent film was discharged straight without winding around the fixing roller. The image thus obtained was measured by a spectrophotometer. As a result, its transmittance was 90%.

What is claimed is:

1. A process for forming a toner image, comprising the steps of forming a toner image on a transparent film comprising a transparent base material and a resin layer provided on the surface thereof and fixing the toner image by heating and pressurizing it, wherein the resin layer has a release oil in a liquid state.

2. The process according to claim 1, wherein the release oil is contained in the resin layer.

3. The process according to claim 1, wherein the release oil is present on the surface of the resin layer.

4. The process according to claim 1, wherein the release oil is silicone oil.

5. The process according to claim 4, wherein the glass transition temperature of the resin component of the resin layer is within a range of the glass transition temperature of the toner ±10° C.

6. The process according to claim 5, wherein the toner is a toner used in forming a color image.

7. The process according to claim 1, wherein the toner contains a release agent.

8. The process according to claim 1, wherein no release oil is applied to a fixing means by heating and pressurizing.

9. The process according to claim 1, wherein the fixing by heating and pressurizing is carried out by a heating roll and a pressure roll.

10. The process according to claim 1, wherein the toner is a polymerized toner.

* * * * *

UNITED STATES PATENT AND TRADEMARK OFFICE

CERTIFICATE OF CORRECTION

PATENT NO. : 6,399,265 B2
DATED : June 4, 2002
INVENTOR(S) : Motohiro Ogura

It is certified that error appears in the above-identified patent and that said Letters Patent is hereby corrected as shown below:

Title page,
Item [56], References Cited, FOREIGN PATENT DOCUMENTS,
"07047776" should read -- 7-47776 --.
"10307416" should read -- 10-307416 --.
"61106293 11/1998" should read -- 61-106293 5/1986 --.

Column 1,
Line 67, "sharply" should read -- abrupt --.

Column 2,
Line 2, "sharply" should read -- abrupt --.
Line 5, "sharply" should read -- abrupt --.

Column 3,
Line 10, "an" should read -- a. --.

Signed and Sealed this

Third Day of December, 2002

JAMES E. ROGAN
*Director of the United States Patent and Trademark Office*